US007600454B2

(12) United States Patent
Kempski et al.

(10) Patent No.: US 7,600,454 B2
(45) Date of Patent: Oct. 13, 2009

(54) FIBER CHOPPER AND METHOD OF CONTROLLING FORCE

(75) Inventors: Douglas James Kempski, Holland, OH (US); Randall Clark Bascom, Wauseon, OH (US); Dan Allen Krage, Milford, OH (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 11/104,096

(22) Filed: Apr. 12, 2005

(65) Prior Publication Data

US 2006/0225546 A1 Oct. 12, 2006

(51) Int. Cl.
*B26D 5/08* (2006.01)

(52) U.S. Cl. ..... 83/13; 83/563; 83/564; 83/915; 83/345; 83/552; 83/27

(58) Field of Classification Search ..... 83/913, 83/950, 552, 563, 564, 345–348, 13, 23, 83/26, 27

See application file for complete search history.

(56) References Cited

U.S. PATENT DOCUMENTS 3,508,461 A 4/1970 Stream
3,704,765 A * 12/1972 Withrow et al. ..... 188/134
3,731,575 A 5/1973 Gelin
3,744,361 A * 7/1973 Van Doorn et al. ..... 83/37
3,858,759 A * 1/1975 Lubenow ..... 222/55
3,869,268 A 3/1975 Briar et al.
4,083,279 A 4/1978 Wester et al.
4,249,441 A * 2/1981 Sturtz ..... 83/347
4,287,799 A 9/1981 Fujita
4,288,704 A 9/1981 Bosard
4,398,934 A 8/1983 Willis
4,576,621 A 3/1986 Chappelear
4,757,731 A * 7/1988 Mohr ..... 83/13
4,942,795 A * 7/1990 Linke et al. ..... 83/72
5,195,415 A * 3/1993 Buck et al. ..... 83/176
5,398,575 A * 3/1995 Rewitzer ..... 83/72
5,582,097 A * 12/1996 Kato et al. ..... 100/2
5,970,837 A * 10/1999 Arterburn et al. ..... 83/552
2004/0025653 A1 * 2/2004 Bascom et al. ..... 83/13

* cited by examiner

*Primary Examiner*—Boyer D Ashley
*Assistant Examiner*—Omar Flores-Sánchez
(74) *Attorney, Agent, or Firm*—Robert D. Touslee

(57) ABSTRACT

A method and apparatus for chopping long unwound items like fiber, fiber strands, yarn, etc. The chopper has a backup roll, a blade roll and a biasing system for forcing the backup roll and the blade roll together at a desired force during set up and operation. The biasing system contains one or more sensors for sensing a biasing force at set up and during operation.

11 Claims, 4 Drawing Sheets

FIBER CHOPPER AND METHOD OF CONTROLLING FORCE

The present invention includes a chopper for one or more strands, the chopper having an improved biasing system. The improved choppers are used to separate long lengths of strand into short segments. The invention also includes a method of chopping while controlling the bias between a backup roll and blade roll with the biasing system. Each strand can be a single fiber, filament, string, wire, ribbon, or strip, or each strand can contain a plurality of fibers, filaments, strings, wires, ribbons or strips.

It has long been known to chop continuous fibers or fiber strands into short lengths of about 3 inches or shorter and billions of pounds of chopped products are produced each year in processes and chopping apparatus like or similar to those disclosed in U.S. Pat. Nos. 5,970,837, 4,398,934, 3,508,461, and 3,869,268, the disclosures of which are incorporated herein by reference. These choppers comprise a blade roll containing a plurality of spaced apart blades for separating the fibers into short lengths, a backup roll, often or preferably driven, which the blades work against to effect the separation. The chopping action also pulls the fibers or fiber strands into the chopper at a proper speed to achieve the desired fiber diameter. In some choppers an idler roll is used to pull and to hold the fibers or fiber strands down onto the surface of the backup roll. In the chopped fiber processes disclosed in these patents, the chopper is usually the productivity limiting equipment in the process. These processes typically operate continuously every day of the year, 24 hours each day, except during furnace rebuilds every few years. Therefore, improvements in the chopper, which allow the chopper to pull and chop faster and for longer times between maintenance shutdowns, and/or to pull and chop more fibers or fiber strands at a time, have an extremely positive impact on productivity and production costs.

In some prior art choppers a mechanical jack operated by a gear motor provided the force needed to bias one of the backup roll or blade roll into the other roll until the blades had penetrated the working layer of the backup roll an appropriate amount. If the blades did not penetrate far enough, double cuts or stringers, long strands, would result, an unacceptable result. If the blades penetrated too far, the chopper would chop the strands properly, but the backup roll life would be shortened substantially. Given these options, at least some operators tended to run the jack motor too long in setting up a rebuilt chopper, or if a chopping problem developed, thus reducing backup roll life substantially below what it could be if the choppers are set up properly. This is a costly situation causing this system to be abandoned in favor of using fluid cylinders with or without shear pins.

Normally several strands such as up to 14 or more are fed into the chopper, each strand containing 2000 or more fibers. As more fiber strands and fibers are fed into the chopper it becomes more difficult to pull all of the strands and fibers at the same speed, so more pressure is applied to the cylinder pushing the idler roll against the backup roll with more force. Occasionally a glass bead from a fiberizing bushing or a wad of fibers will be pulled to the chopper caught up in the multitude of fiber strands. When this happens, it is necessary for one of the backup roll or blade roll to be able to move away from the other roll to allow this thicker anomaly to pass through the nip between the blade roll and the backup roll. If this separation does not occur the chopper will often lock up causing damage to the drives, belts and/or the rolls.

Although at least one of the rolls is held in position with a fluid cylinder, the fluid is either not compressible or responds too slowly to the sudden problem to protect the chopper from damage and downtime. In the past the shear pin was used to provide such protection. However, when the shear pin shears the blade roll and backup roll are no longer biased together properly requiring that the chopper be shut down to install a new shear pin. This downtime is costly because of the loss of production during the downtime and due to reduced material efficiency for several minutes following restart. Downtime causes forehearth and bushing temperature upsets because hanging fibers do not pull in cooling air that occurs when the chopper is pulling the fibers from the bushings. Also, there is a tendency on the part of the operator, if the chopper is not chopping the strand properly, to increase the biasing force excessively and this drives the blades of the blade roll too deep into the elastomeric working layer of the backup roll and substantially shortens the life of the backup roll.

If all of the strands or fibers are not pulled at the same speed, the slower strands and fibers will have a greater fiber diameter which is unacceptable and the bushings of the slower strands frequently will not operate at the proper temperature causing more frequent breakouts and/or additional fiber diameter variations, both of which are unacceptable. Also, fiber slippage can cause some of the fibers to be cut to shorter lengths than desired resulting in an unacceptable product. Therefore, it is very important that the biasing force between the blade roll and the backup roll remain proper and essentially constant.

As the pulling speed is increased, and/or as the number of strands and fibers are increased, above about 3000-4000 ft./min. (FPM), depending on the product, the present state of the art choppers begin to vibrate and the idler roll begins to allow one or more of the strands to slip some thus reducing the pulling speed of one or more of the strands. Also, if all of the strands are not pressed between the idler roll and the elastomer layer of the backup roll, a strand can slip partially out of the nip leaving some of the fibers unchopped, producing double cuts and stringers in the chopped product and causing the product to be scrapped.

U.S. Pat. No. 3,731,575 teaches an air cylinder with an adjustable stop to bias the blade roll against the backup roll so that the blades penetrate the backup roll the desired distance and no further. However, with this arrangement, the pressure in the cylinder increases when a wad or bead or other thicker strand set passes through the chopper and forces the backup roll to back away from the blade roll. Also, an air cylinder bias is subject to permitting vibration at high speeds and is therefore not desirable. Finally, this system suffers the same problem as the mechanical jack system in that it requires an operator to set the mechanical stop limiting the distance the blades can penetrate the working layer of the backup roll.

It would be very desirable for the chopper operator to know what the magnitude of force or bias is, when he is first setting up the chopper and when the chopper is operating. With that information the operator could tell if something has changed and needs adjustment, and the operator could then properly manipulate the assembly providing the biasing force to raise the biasing force back to the desired level. Alternatively, the control system could use that feedback signal to automatically adjust the assembly providing the bias to keep the magnitude of force or bias at the desired level The present invention comprises a chopper for separating long a long strand or strands, the strand or strands comprising one or more fibers, filaments, wires, strings, ribbons or strips, into short segments, the chopper having a biasing system that comprises a strain gauge as part of the biasing system. One or more strain gauges detect, either directly or indirectly, the magnitude of force biasing the backup roll and the blade roll toward each other, i.e. the magnitude of force holding the two rolls in operating or chopping engagement. The strain gauge (s) can be of any suitable type and placed in one or more of numerous locations that will provide a reading of the magnitude of force on a mechanical jack providing the biasing force or on a structural member transmitting the biasing, the engaging force.

The invention also includes a method of separating a strand or strands, each strand comprising one or more fibers, filaments, wires, strings, ribbons or strips, or combinations of two or more thereof, into short segments using the improved chopper of the invention. In the method one or more strands are guided into a nip formed between a backup roll and a blade roll of the chopper biased together with a biasing system comprising one or more strain gauges and using the output of the one or more strain gauges to set and/or control the biasing force during set-up and operation of the improved chopper. The more constant biasing force between the backup roll and the blade roll optimizes the life of the backup roll and significantly improves productivity of the chopped fiber forming operation.

The strain gauge, using an analog output to a PLC, provides a real time display to the operator and process engineers informing them concerning forces optimum for cutting and/or protection of equipment. The strain gauge data can be used to set up the chopper for operation after installing one or both of a new blade roll and a new backup roll, as an informational process optimization tool and also for process control and bias magnitude control during operation of the chopper of the invention.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION OF THE INVENTION

Figure 1:
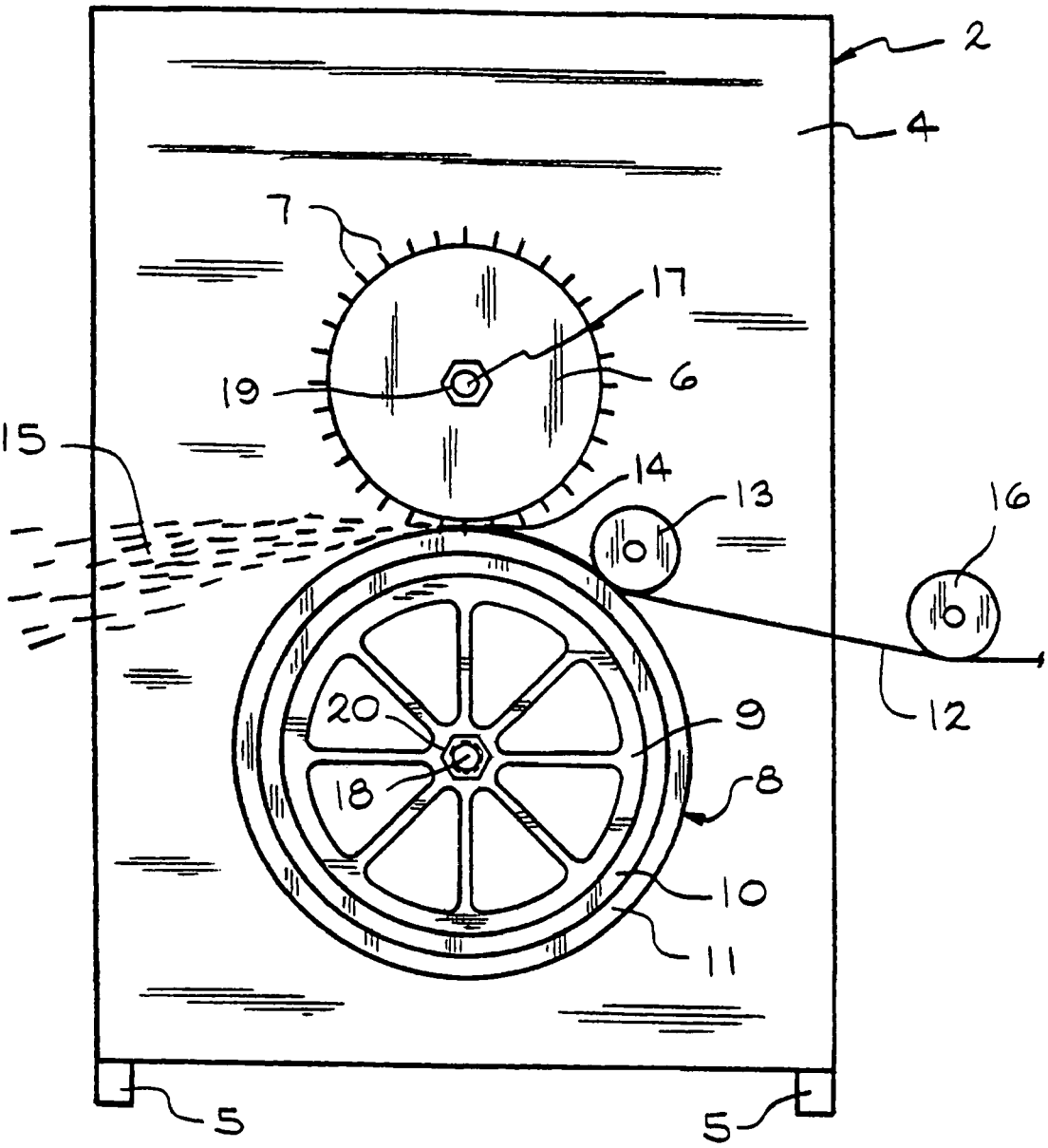
FIG. 1 PRIOR ART
FIG. 1 is an elevational front view of a chopper of the present invention.

FIG. 1 shows a front elevation view of a typical chopper 2 used in making chopped strand glass fiber. It comprises a frame and front plate 4, feet 5, a blade roll 6 with spaced apart blades 7 contained in slots and projecting from the periphery of a blade holder integrated into the blade roll 6, a backup roll 8 and an idler roll 13. The blade roll 6 is mounted on a rotatable spindle 17 and held in place with a large nut 19. The blade roll 6 is usually made of metal and thermoplastic material such as the blade rolls shown in U.S. Pat. Nos. 4,083,279, 4,249,441 and 4,287,799, the disclosures of which are herein incorporated by reference.

The backup roll 8 is comprised of a hub and spoke assembly 9 with an integral metal rim 10 on which is cast or mounted a working layer 11 of an elastomer or thermoplastic material such as polyurethane. The backup roll 8 is mounted on a second spindle 18 and held in place with a large nut 20. To operate the spindle 18 of the backup roll 8 is moved towards the spindle 17 of the blade roll 6 until the blades 7 of the blade roll 6 press into the working layer 11 of the backup roll 8 a proper amount forming a nip 14 to break or separate fiber strands 12 into an array of short lengths.

One or more, usually eight or more and up to 20 or more strands 12, such as glass fiber strands, each strand containing 400-6000 or more fibers and usually having water and/or an aqueous chemical sizing on their surfaces, are pulled by the backup roll 8, in cooperation with a knurled idler roll 13, into the chopper 2 and the nip 14. The strands 12 first run under a grooved oscillating, separator and guide roll 16, preferably with one or two strands in each groove, and upward and over the outer surface of the backup roll 8. The working surface of the back up roll 8 is typically wider than the oscillating path of the glass fiber strands 12. The strands 12 then pass under the outer knurled surface of the idler roll 13, which is pressed against the strands at a desired pressure to enable pulling of the glass fiber strands. The strands remain on the surface of the working layer 11 and next pass into the nip 14 between the backup roll 8 and the blade roll 6 where they are separated with the razor sharp blades 7 wherein the strands are usually cleanly cut or broken into an array of chopped strand 15 having the desired length.

The improved chopper 2 of the present invention and illustrated in FIGS. 1-5 comprises a novel biasing system such as a preferred biasing assembly 24. The backup roll spindle 18, in turn holding the backup roll 8 in a rotatable manner, is supported with multiple bearings in a known manner on a pivoting beam 20 that is held in a pivoting manner with a pin 22. As the pivoting beam 20 is raised, the outer working surface of the backup roll 8 is pressed against the blades 7. The biasing assembly 24 is attached to the pivoting beam 20 in a manner that will be described later and a mechanical jack 26 is manipulated to bias the backup roll 8 against the blades 7 of the blade roll 6 in the manner shown in FIG. 2.

Figure 3:
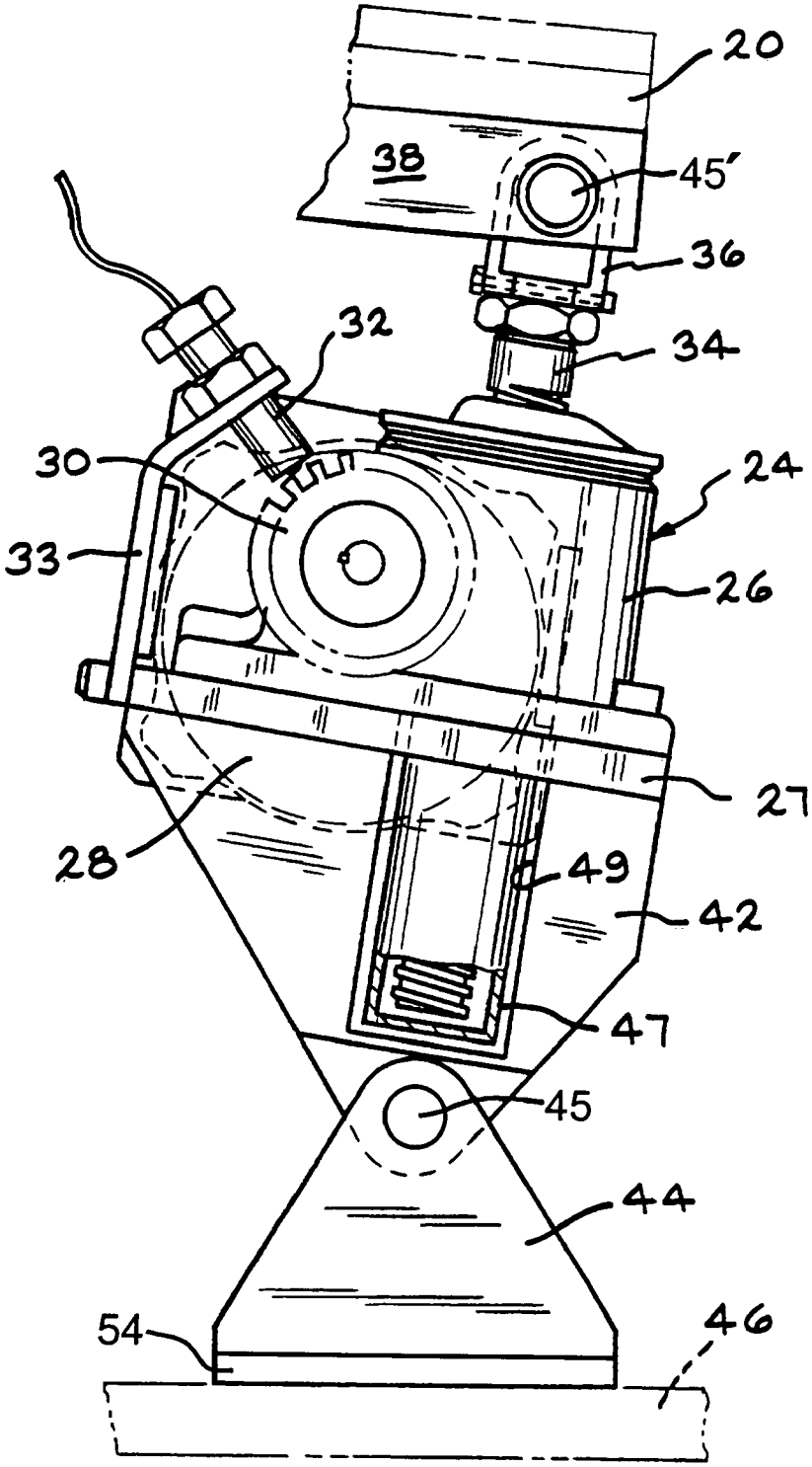
FIG. 3 is a blown up elevational view of the biasing systems shown in FIG. 2.
Figure 4:
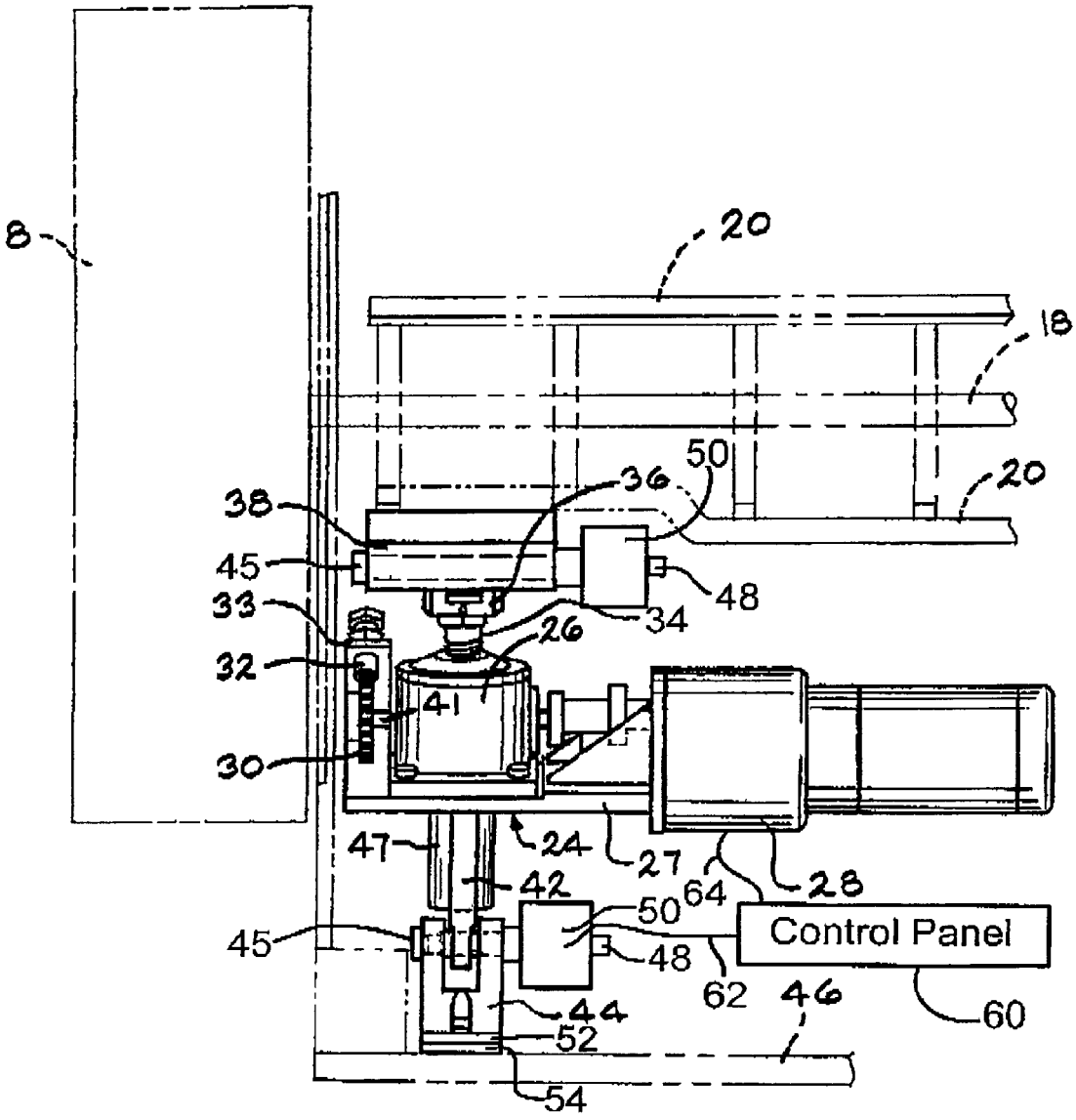
FIG. 4 is a partial side view of the embodiments shown in FIG. 2.

FIGS. 3-4 show the most typical embodiment of the biasing assembly of the present invention in more detail. The preferred biasing assembly 24 is comprised of a mechanical jack 26, such as an Acme screw jack called a having a rotatable in put shaft 35 for extending or retracting a rod 34 of the screw jack, a rotating means such as a conventional stepping motor, conventional motor and gear reducer or gearhead motor combination 28 having an output shaft 29, conventional controls for the gear motor contained in a control panel 60 and communicating with the motor 28 (FIG. 4) via wire(s) 64, a conventional coupling (not shown) for connecting the gear motor 28 to the rotatable shaft 35 and means for securing one end of the screw jack 26 to the frame of the chopper and the other end to the pivoting beam 20. When a stepping motor is used as the motor 28, a conventional programmed control in the control panel 60 can be used allowing the operator to key in the number of steps for the stepping motor to advance or backoff. All motors used are reversable motors.

Figure 2:
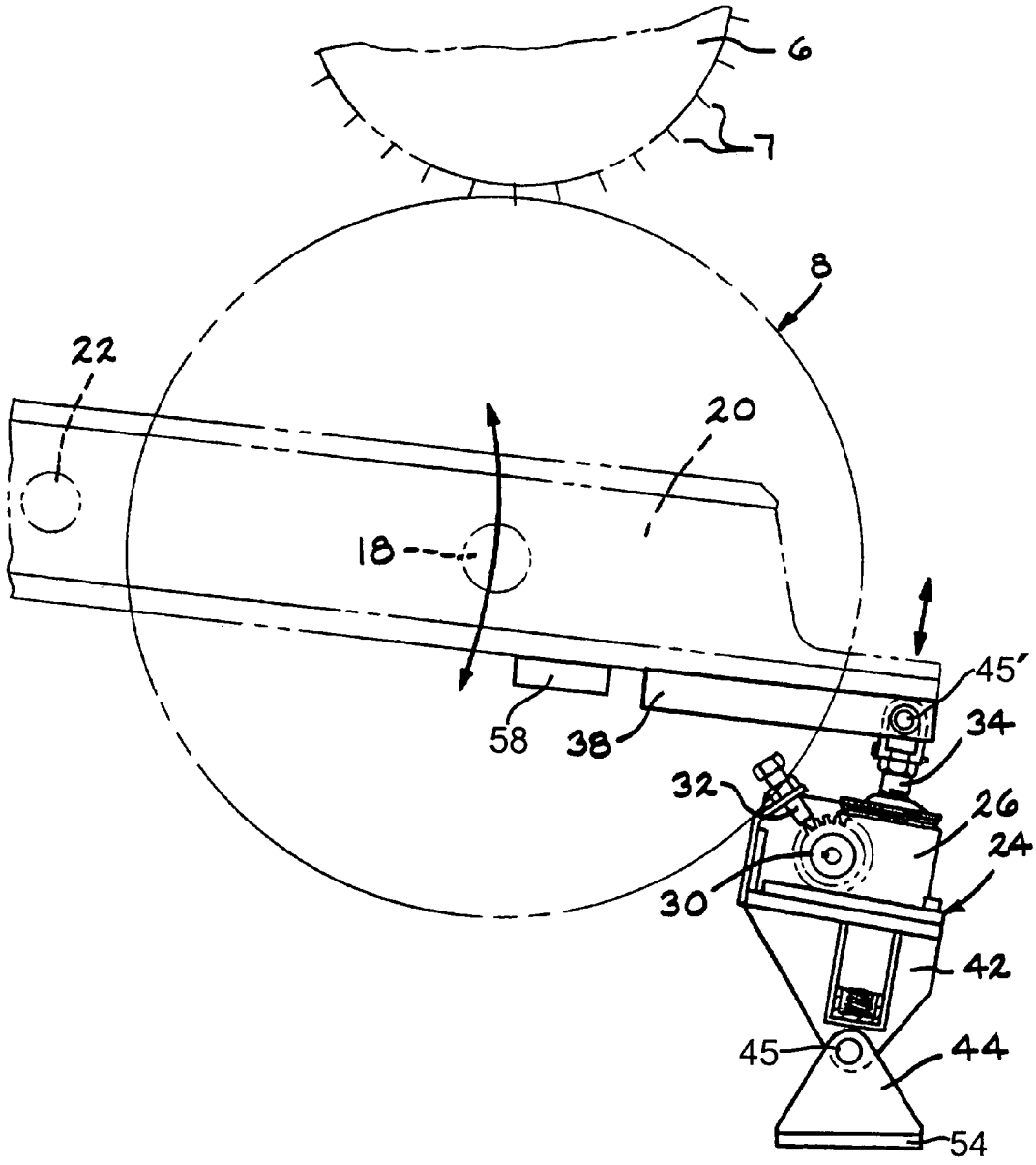
FIG. 2 is a partial elevational view of the interior of the chopper shown in FIG. 1 and shows the support for the backup roll and backup roll spindle and a some typical embodiments of the biasing system of the present invention.

The means for securing mechanical extenuating means or screw jack 26 to the pivoting beam 20 preferably comprises a clevis mount 38 having a hole therethrough and an opening for a clevis attached in any known suitable manner to the underneath surface of the outer end of the pivoting beam 20 as shown in FIG. 2. A clevis 36 is rotatably attached to the end of the mechanical jack rod 34 in a known manner. The clevis 36 is then pivotly attached to the clevis mount 38 according to one embodiment of the invention with a strain gauge pin 48 having a load cell pin or bolt 45". This load cell pin or bolt contains a strain gauge and can be of many types. One type is a load cell pin or bolt produced by the Strainsert Company of West Conshokocken, Pa. When a load is applied to the load cell pin 45", a strain gauge wire mounted inside the pin or bolt senses the amount of force and transmits an electrical signal indicating the magnitude of force. As will be seen later, the strain gauge can be in other locations, such as a compression load cell 54 placed under a clevis bracket 44, or a load cell pin or bolt 45 used to mount the jackscrew 26 to the clevis bracket 44. Also, a strain gauge can be attached to any part of the biasing assembly that will be under load during operation or set up for operation such as on the pivot beam 20, e.g. see the strain gauge 58 attached to the underneath side. More than one strain gauge can be used at the same time, but usually not necessary. Normally only one strain gauge or strain gauge load cell placed in a manner to sense the biasing force is necessary and its type and location can be a matter of choice.

As shown in FIG. 3, the means for attaching the mechanical jack means, screw jack 26 and jackscrew-housing 47 for the jackscrew that is the lower portion of shaft 34 is a plate 42 having on one end an integral eye 42. The other end of the plate 42 is attached to the underneath side of the mounting plate 27, preferably centered under the body of the screw jack 26, in any suitable manner, such as with threaded metal bolts whose heads are recessed in the top portion of the mounting plate 27. The plate 42 has a cutout portion 49 so the plate 42 can straddle the jackscrew housing 47 as shown in FIG. 3. This preferred means for securing the mechanical jack 26 to the frame of the chopper comprises pivotly attaching the eye 45 of plate 42 to a mounting bracket 44 with a clevis pin or a load cell pin or bolt 45. The mounting bracket 44 can be attached in a known manner to a lower frame member 46 of the chopper and can alternatively set on a compression load cell 54, according to the invention. As seen in FIG. 4, a transmitter 50 is mounted onto the clevis pins 45 and 45' outside the brackets 44 and 36 respectively. The transmitter 50 sends a signal to a display, and optionally also to an input of a controller circuit, in the control panel 60 via a wire(s) 62 or wirelessly in a known manner.

Referring to FIG. 4, a motor 28 is energized and rotates its output shaft, coupled to the input side of the screwjack 26 in a known manner.

This biasing system also optionally comprises a toothed gear 30 attached to a rotatable output shaft 41 of the mechanical jack 26, a tooth sensor and counter 32 for counting the number of passing teeth of the toothed gear 30, a bracket 33 for holding the tooth sensor and counter 32 in the proper location, and a mounting plate 27 for mounting the mechanical jack 26, the gear motor 28 and the bracket 33.

To operate the preferred chopper biasing system described above, the operator first either selects a desired amount of force to use in manually driving the motor 28 and screwjack 26 applying the bias forcing the backup roll and blade roll together, or optionally sets the desired force limit in the control panel to automatically achieve the same objective. A force limit for the type of chopper shown in FIG. 1 is one that will allow the screw jack 26 to exert about 1000 pounds force, but again this depends upon the design of the chopper and the hardness of the elastomeric working layer on the backup roll. In the biasing system shown in this embodiment of the invention, the motor 28 turns in a direction that will cause the screw jack 26 to raise the jackshaft 34 thus raising the pivoting beam 20. The screw jack 26 will continue to raise the backup roll 8 into the blades 7 until the resistance of the blades penetrating the elastomer layer of the backup roll 8 reaches level where the torque on the input shaft 35 of the screw jack 26 reaches the desired force limit, which is the force required to force the blades 7 the desired distance into the working layer 11 of the backup roll 8. In other embodiments of the invention, the blade roll 6 is moved towards the backup roll 8, and both the backup roll 8 and the blade roll 8 are moved towards each other at the same time or sequentially. The stepping motor is usually stopped when the chopper is shut down and reversed to back the backup roll 8 away from the blades 7 when it is desired to remove the blade roll 6 and/or the backup roll 8.

Any kind of mechanical jack can be used in the inventive biasing system, but it is preferred to use one of lower mechanical advantage, i. e. preferably less than about 10:1 to minimize the pressure that can build up in the nip between the backup roll 8 and the blades 7 due to a thicker feed before it is relieved and to reduce the reaction time to relieve the pressure. A preferred screw jack is a Duff-Norton 2-ton Machine Screw Actuator #TM-9002-4, 6:1 ratio with a 4 inch stroke available from the Duff-Norton Co. of Charlotte, N.C.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A method of separating long lengths of unwound item(s) selected from the group consisting of fibers, fiber strands, string, yarn, wire, tape and ribbon into short pieces comprising feeding one or more items in an unwound form into a chopper comprising a frame, a rotatable backup roll outboard of one side of the frame, the backup roll having a peripheral elastomeric working layer, a rotatable blade roll outboard of the side of the frame, the blade roll having a plurality of blades residing in slots in a second elastomer, the second elastomer having a Shore A hardness greater than that of the elastomer working layer of the backup roll, the plurality of blades being spaced apart around its periphery for contact with and penetration of said items and into the peripheral elastomeric working layer of the backup roll and a biasing system for biasing the blades of the blade roll and the backup roll together, the biasing system comprising a mechanical jack that extends and retracts as an element of the mechanical jack is rotated first in one direction to extend and in the opposite direction to retract, and a motor assembly for rotating said element, and operating the chopper, the improvement comprising using a biasing system comprising an assembly for biasing the blade roll and the backup roll together with a force, the magnitude of the force being that which will cause the blades to penetrate the peripheral elastomeric working layer of the backup roll to a desired distance to separate the unwound items, said assembly comprising one or more strain gauges or load cells providing data for bias control using input from the one or more strain gauges or load cells and an output for the motor assembly to maintain the desired magnitude of biasing force during the separating of the unwound items.

2. The method of claim 1 wherein the motor is a stepping motor actuated by a control system in response to a signal from the one or more strain gauges or load cells, the control system maintaining a substantially constant and desired torque to the element of the mechanical jack during at least a portion of the setup and during operation of the chopper, said torque resulting in the blades of the blade roll penetrating the working layer of the backup roll only the desired depth.

3. The method of claim 1 wherein the motor assembly is a stepping motor and the operator activates the stepping motor sufficiently to obtain the desired bias on the biasing system of the chopper prior to operation of the chopper for said separating.

4. The method of claim 1 wherein the biasing system provides data showing the magnitude of the biasing force.

5. The method of claim 4 wherein the mechanical jack is a screw jack and the bias system comprises a compression load cell located beneath the screw jack to keep the magnitude of bias at the desired level.

6. The method of claim 5 wherein the biasing system also comprises a control system that uses a signal from the load cell to activate the stepping motor to control the magnitude of bias between the blades and the working layer of the backup roll.

7. The method of claim 5 wherein the biasing system assembly further comprises a toothed gear connected to the rotating element of the mechanical jack and a sensor for sensing or counting teeth on the toothed gear moving past the sensor.

8. The method of claim 1 wherein the biasing system comprises a load cell and the mechanical jack is a screw jack.

9. The method of claim 8 wherein the biasing system also comprises a control system that uses a signal from the load cell to activate a stepping motor to control the magnitude of bias between the blades and the working layer of the backup roll.

10. The method of claim 1 wherein the biasing system comprises a strain gauge.

11. The method of claim 10 wherein the biasing system also comprises a control system that uses a signal from the one or more strain gauges to activate the motor assembly, the motor being a stepping motor, to control the magnitude of bias between the blades and the working layer of the backup roll.

* * * * *